US005495873A

United States Patent [19]

Butkiewicz et al.

[11] Patent Number: 5,495,873

[45] Date of Patent: Mar. 5, 1996

[54] PATTERNED AIR GAP ENGINE EXHAUST CONDUIT

[75] Inventors: Steven J. Butkiewicz, Wyoming; Samuel H. Carrier, Ravenna; Donald L. Fellows, Jr.; Frederick B. Hill, Jr., both of Rockford; Earl W. Mattson, Cedar Springs; Terrence L. Scofield, Alto, all of Mich.

[73] Assignee: Benteler Industries, Inc., Grand Rapids, Mich.

[21] Appl. No.: 136,415

[22] Filed: Oct. 13, 1993

[51] Int. Cl.[6] ..... F16L 9/18

[52] U.S. Cl. ..... 138/114; 138/148; 138/177; 138/DIG. 11; 607/321

[58] Field of Search ..... 138/112, 114, 138/116, 148, 177, DIG. 11; 181/228; 60/321, 322, 282; 285/229

[56] References Cited

U.S. PATENT DOCUMENTS

| | | | |
|---|---|---|---|
| 421,366 | 2/1890 | White | 138/114 |
| 531,000 | 12/1894 | Morrison | 138/114 |
| 1,218,895 | 3/1917 | Porter | 138/148 |
| 2,179,057 | 11/1939 | Schuetz | 138/148 |
| 2,259,433 | 10/1941 | Kitto | 138/148 |
| 2,451,131 | 10/1948 | Vidal | 72/61 |
| 2,663,321 | 12/1953 | Jantsch | 138/DIG. 11 |
| 2,667,041 | 1/1954 | Henderson | 62/103 |
| 2,878,837 | 3/1959 | Burtt | 138/148 |
| 3,133,612 | 5/1964 | Sailler | 138/148 |
| 3,340,711 | 9/1967 | Agin | 72/61 |
| 3,543,878 | 12/1970 | Hamilton | 181/228 |
| 3,785,170 | 1/1974 | Beranek | 138/114 |
| 3,911,961 | 10/1975 | Peyton | 138/148 |
| 4,037,626 | 7/1977 | Roberts, Jr. | 138/148 |
| 4,250,708 | 2/1981 | Tanahashi | 60/322 |
| 4,475,341 | 10/1984 | Inoue | 138/148 |
| 4,484,785 | 11/1984 | Jackson | 138/112 |
| 4,501,302 | 2/1985 | Harwood | 138/114 |
| 4,585,059 | 4/1986 | Lee | 138/114 |
| 4,615,359 | 10/1986 | Affa et al. | 138/114 |
| 4,821,840 | 4/1989 | Harwood | 181/228 |

FOREIGN PATENT DOCUMENTS

| | | | |
|---|---|---|---|
| 2915838 | 4/1979 | Germany | 138/114 |
| 0008204 | 3/1894 | Switzerland | 138/116 |

*Primary Examiner*—David Scherbel
*Assistant Examiner*—James F. Hook
*Attorney, Agent, or Firm*—Price, Heneveld, Cooper, DeWitt & Litton

[57] ABSTRACT

An acoustically improved, air gap engine exhaust conduit having a dual wall, air gap, metal exhaust conduit of an outer jacket and a thin inner liner, the jacket having at least one exhaust gas inlet and an exhaust gas outlet, the liner having at least one inlet and an outlet, the jacket inlet and the liner inlet being adjacent each other, the liner being secured to the jacket adjacent the jacket inlet and the liner inlet, the liner outlet being optionally in engagement with the jacket, and the liner otherwise being spaced from the jacket over its length to form a continuous air gap from the liner inlet to the liner outlet, a pattern of indentation ribs protruding into or out of the jacket over substantially all of said jacket, each indentation rib protruding toward or away from the liner, and terminating short of the liner to be spaced from and not in engagement with the liner, to maintain the continuous air gap. Optionally, the liner can have a pattern of indentation ribs protruding inwardly or outwardly and, if the latter, terminating short of the jacket so as not to engage the jacket and leave an air gap over the length thereof.

17 Claims, 5 Drawing Sheets

PATTERNED AIR GAP ENGINE EXHAUST CONDUIT

BACKGROUND OF THE INVENTION

This invention relates to dual wall, air gap engine exhaust conduits, such as exhaust pipes, downpipes, exhaust manifolds and the like, and more particularly to air gap exhaust conduits having superior acoustical properties and excellent thermal operational efficiency.

Exhaust component technology has changed markedly over recent decades, from simple cast exhaust manifolds and ordinary steel exhaust pipe components, to sophisticated, lightweight and durable systems including catalytic converters. Lightweight stainless steel exhaust manifolds are replacing the heavy cast structures. Recent developments have enabled dual wall, air gap, heat durable steel exhaust manifolds to be readily economically produced. This type of manifold includes a thin inner liner and an outer jacket. Exhaust pipe components such as downpipes likewise have been developed with a thin inner liner and a thicker outer jacket. These thin liners heat rapidly from the exhaust gases after engine startup, to achieve quicker "light off" of the downstream catalytic converter. The result is a much more efficient system with emissions that meet federal standards.

However, noise radiation is a drawback to these lightweight systems. Hence, efforts have been made heretofore to modify these systems for improving sound quality and reducing sound intensity. Typically, the prior art mechanisms use friction to reduce noise. Frictional contact between the components, however, also involves the creation of a heat sink, i.e., thermal inertia, which detracts significantly from the quick temperature rise needed in the structure for emissions control.

Another noise control technique which was suggested years ago was to form an air gap to reduce noise and have one or both walls of a double wall conduit crimped to form surface deformations which served to hold one wall partially spaced from the other by engaging the other wall with the undulations or crimp areas so formed, as in U.S. Pat. No. 3,133,612. However, these very deformations create substantial physical contact and thermal exchange between the inner and outer walls along the length thereof. That was acceptable in the early 1960's, but today's environmental requirements demand that the catalytic converter light off shortly after engine startup, which necessitates low heat energy absorption in the inner liner without creating a heat sink of the type that would result from the structures in that patent.

It has been determined that the emissions standards can be met if the liner is spaced from the jacket everywhere except at the inlet ends of the liner and jacket, and at the outlet of the liner, while also achieving improved sound characteristics. Crimping or indentations in the outer jacket which would engage the liner along the length of the structure, so as to create a heat sink and thereby heat inertia, are to be avoided, since that severely detracts from the thermal efficiency of the liner structure.

The applicants herein have discovered an engine exhaust conduit structure that employs indentations in the jacket in a manner which does not hinder the thermal efficiency of the air gap, dual wall structure, and significantly improves sound quality.

SUMMARY OF THE INVENTION

An object of this invention is to provide an engine exhaust conduit such as a downpipe or an exhaust manifold that has improved acoustical characteristics, while also having excellent thermal efficiency so as to cause rapid "light off" of the catalytic converter after engine startup. The exhaust conduit is a dual wall, metallic, heat durable material structure having an outer jacket and a thin inner liner, both having one or more exhaust gas inlets and the liner being attached to the jacket at the inlets. The liner engages the jacket directly or indirectly only at this inlet and also at the liner outlet, which may or may not coincide with the jacket outlet. Formed into the jacket and/or liner over substantially all of its outer surface is a pattern of elongated, concave or convex rib indentations which preferably protrude from the jacket toward, but definitely stop short of the liner, so as to be spaced from and not engage the liner, thereby maintaining a continuous air gap between the liner and the jacket. Optionally, the indentations may protrude externally. Thus, the ribs may be concave or convex.

The resulting structure has been found to achieve the necessary emission control qualities, but also result in lower sound levels as well as having better, more mellow, acoustical quality compared to prior known structures.

These and other objects, advantages and features of this invention will become apparent upon studying the following specification in conjunction with the drawings.

DESCRIPTION OF THE PREFERRED EMBODIMENTS

Figure 1:
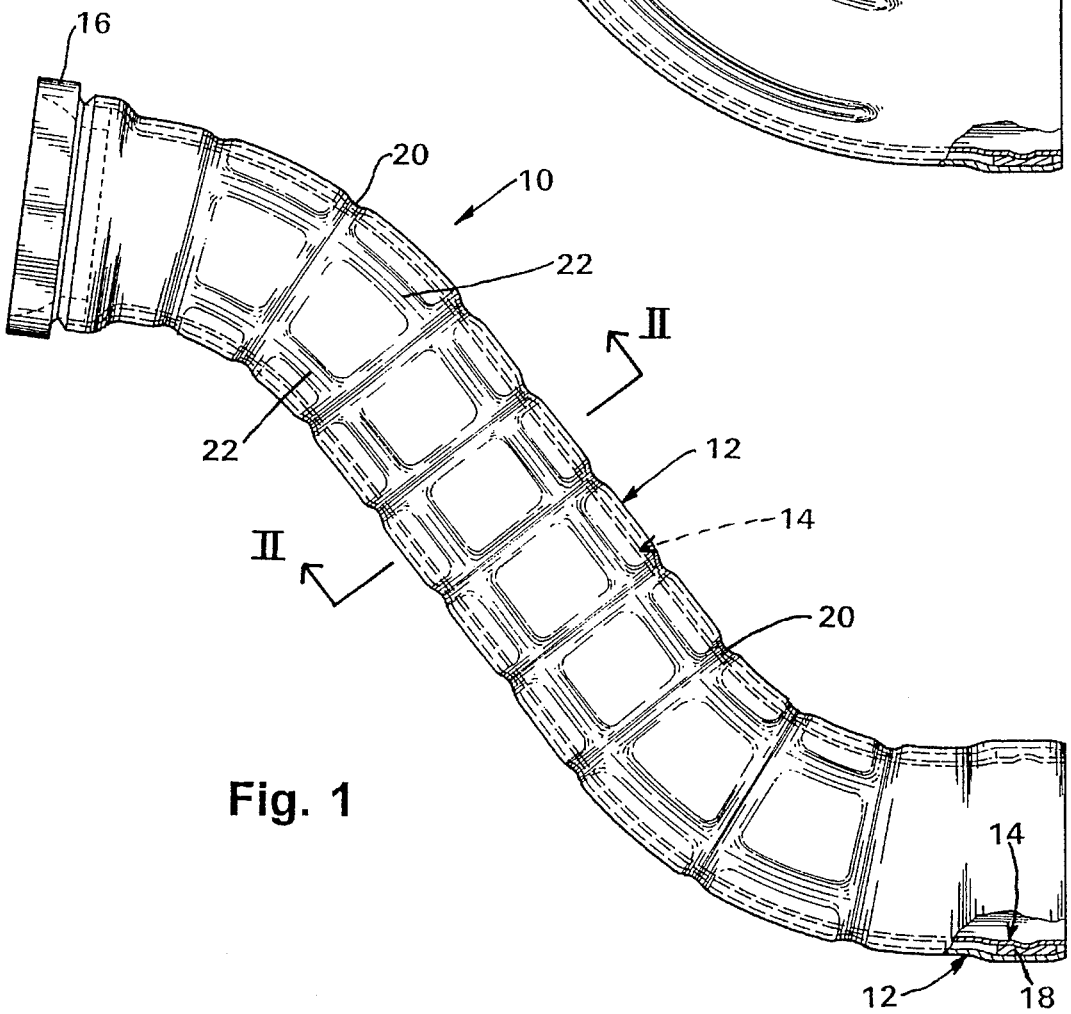
FIG. 1 is an elevational view of an air gap downpipe showing the first embodiment of this invention.

Referring now to the drawings, and particularly to FIG. 1, the exhaust conduit downpipe 10 there shown comprises a tubular member having an air gap construction formed by an outer jacket 12 and an inner liner 14 which are held spaced apart from each other over their length, being secured together at both the inlet end and the outlet end. The inlet end preferably includes an annular coupling 16 which secures inner liner 14 to outer jacket 12, as well as being useful for connection to an exhaust manifold outlet (not shown). The outlet end includes a spacer connector 18 securing liner 14 to jacket 12 and being in indirect contact therewith. Both the liner and the jacket are preferably formed of stainless steel, with liner 14 typically being considerably thinner so as to optimize rapid temperature rise from heat exchange with exhaust gases passing therethrough. This exhaust conduit downpipe may be attached, for example, in a conventional fashion, to an exhaust manifold at inlet coupling 16, and attached at the outlet end of downpipe 10 to a downstream exhaust conduit components such as a catalytic converter and a muffler. Over substantially all of the surface of jacket 12 is a pattern of elongated rib indentations which protrude radially inwardly or outwardly. Preferably, the rib indentations protrude an amount which is about one-half of the air gap width, e.g., about 1.5 mm, adding stiffness to the jacket wall. Each indentation is here shown as a concavity, as viewed from the exterior, and which protrudes toward but stops short of the inner liner 14 so as not to engage the liner. It is important that these concavities not engage liner 14 since that would detract markedly from the thermal efficiency of the unit by providing a heat sink with substantial thermal inertia. The indentations may alternatively protrude outwardly to form convexities as viewed from the exterior, or concavities when viewed from the interior.

The pattern of the embodiment in FIG. 1 includes not only a plurality of spaced annular concavities 20 extending around the pipe, but also axially elongated concavities 22 running substantially the length of downpipe 10. Concavities 22 are at circumferentially spaced intervals around the downpipe. Axial concavities 22 and annular concavities 20 cross each other to form a plurality of block-type segments in a generally "waffle-type" pattern. Experimental testing with the downpipe has shown remarkable acoustical improvement for the exhaust system. The indentation pattern in the outer jacket, without touching the inner liner and thus leaving the elongated air gap, has been shown to cause markedly superior acoustical characteristics over previous air gap exhaust conduit units. This superior performance in sound radiation is not fully understood, but is believed due to various factors including the wall being rendered more rigid by the indentation pattern, and the sound waves emanating from the surface being rendered, by the unevenness of the surface, more diffused.

Figure 3:
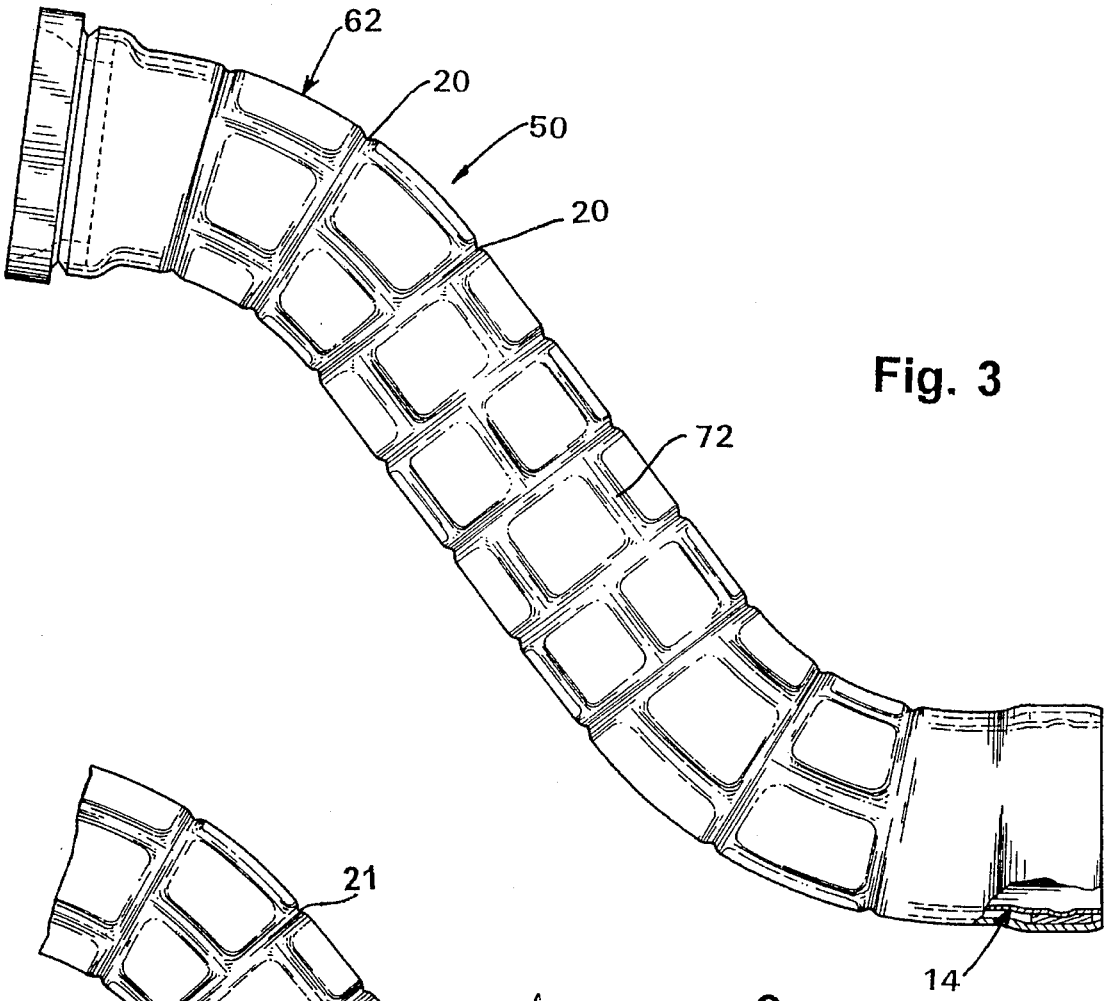
FIG. 3 is an elevational view of an air gap downpipe showing a second embodiment of the invention.

In FIG. 3 is shown a modified form of downpipe 50 wherein the outer jacket 62 has the series of annular concavities 20 as in the first embodiment, but the axially oriented concavities 72 are peripherally offset in each axial segment so as to form an aligned, "brick-type" pattern. More specifically, the axial grooves 72 in one axial segment between two adjacent annular concavities 20 are circumferentially offset from the axially oriented concavities 72 in the segments in both directions thereof. In this embodiment also, these concavities 20 and 72 protrude radially inwardly toward the inner liner 14 (optionally outwardly), but spaced therefrom, so as not to interrupt the continuous air gap extending between the ends of the conduit.

Figure 4:
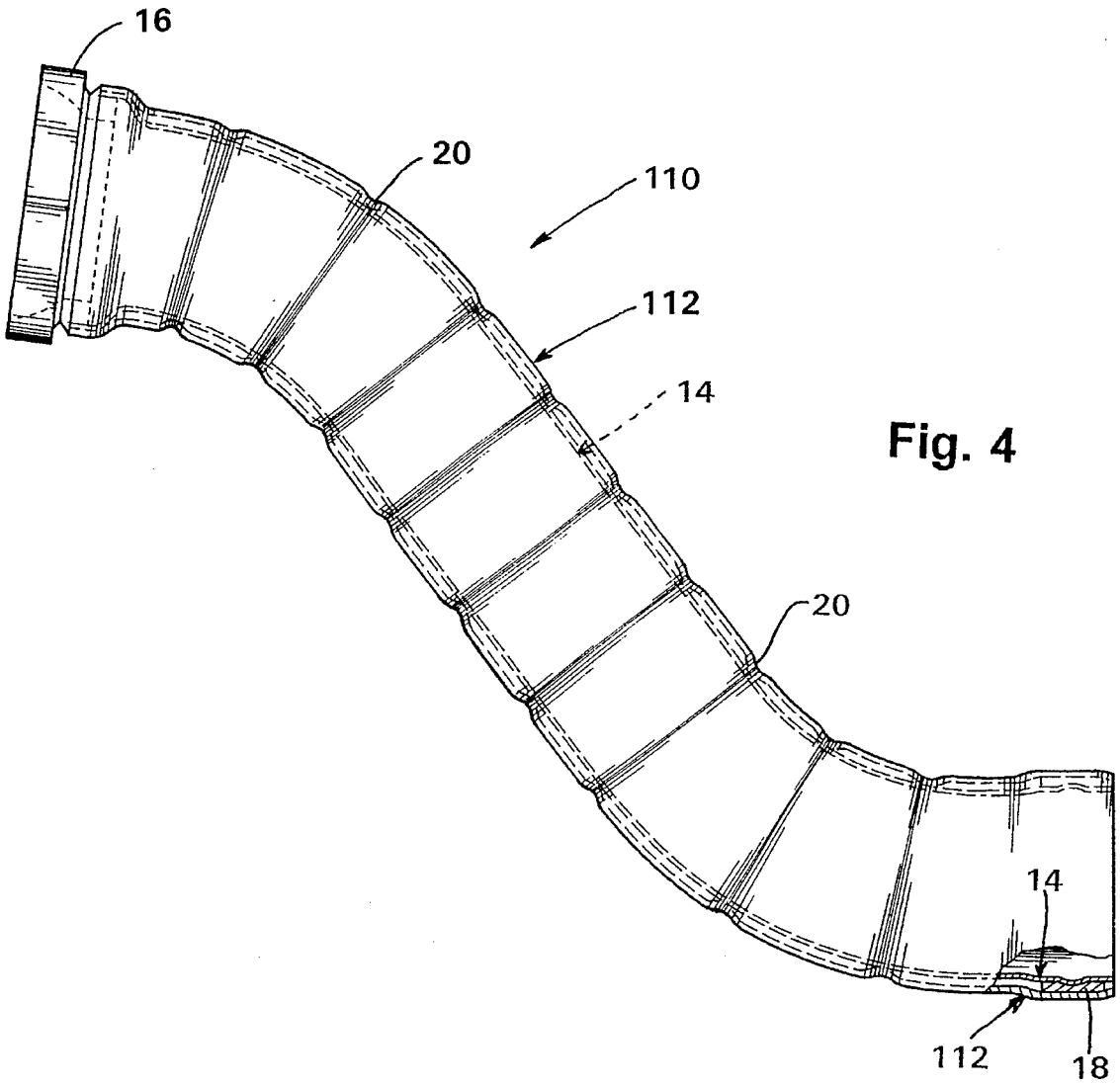
FIG. 4 is an elevational view of an air-gap downpipe showing a third embodiment of the invention.
Figure 2:
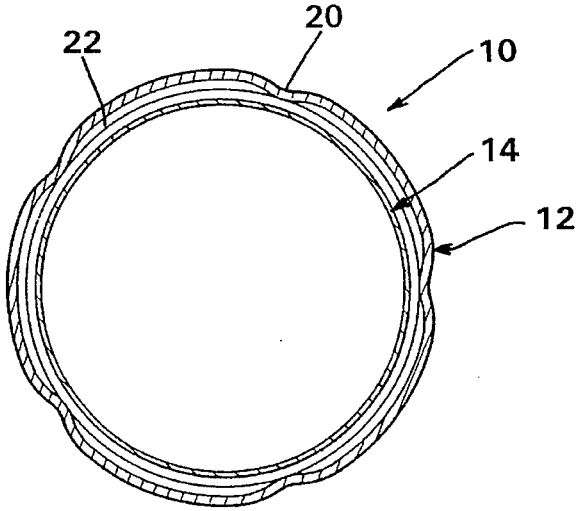
FIG. 2 is a cross sectional view taken on plane II—II of FIG. 1.

Referring to FIG. 4, this downpipe 110 has an inner liner 14 spaced from an outer jacket 112 so as to form a continuous air gap extending between the ends of the conduit, and specifically the inlet end where attachment coupling 16 is located, and the outlet end where annular spacer connector member 18 secures the liner and jacket together. Substantially over the length of the jacket is the plurality of annular concavities 20, axially spaced from each other. Each concavity protrudes radially inwardly toward liner 14 (optionally outwardly), with a curvilinear configuration, but terminating short of the liner, so as not to cause heat sink characteristics by thermal conductivity from the liner to the jacket.

Figure 5:
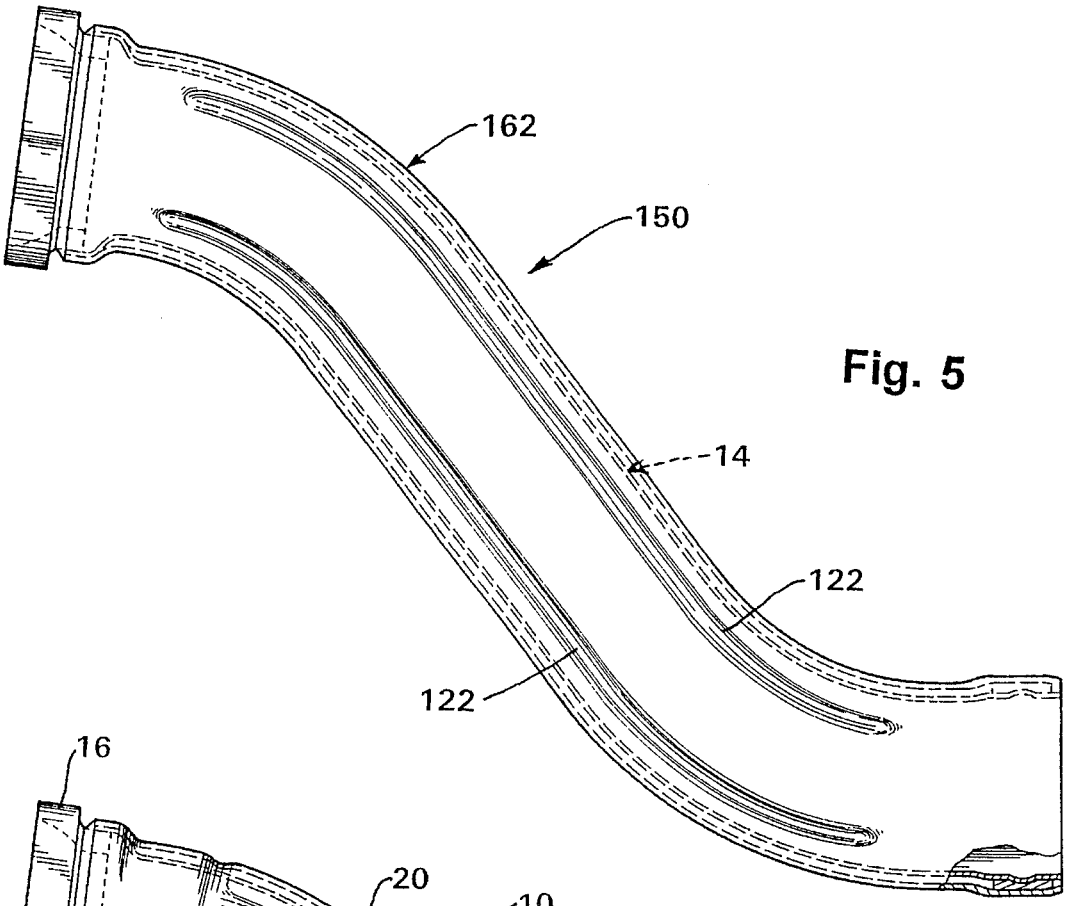
FIG. 5 is an elevational view of an air gap downpipe showing a fourth embodiment of the invention.

The downpipe 150 in FIG. 5 comprises an outer jacket 162 and an inner liner 14 spaced therefrom over the length of the downpipe. In this embodiment, outer jacket 162 has a plurality of elongated continuous indentations 122 extending substantially the length of the conduit and spaced from each other around the periphery of jacket 162. Again, concavities 122 protrude radially inwardly toward liner 14 but do not physically engage it, being spaced therefrom to not interrupt the continuous air gap between the ends of the conduit.

Optionally, the liner could have a rib pattern like those in the above-described embodiments. If so, the rib indentations could be inward or outward, i.e., concave or convex as viewed from the exterior, but with the ribs not engaging the jacket.

Figure 6:
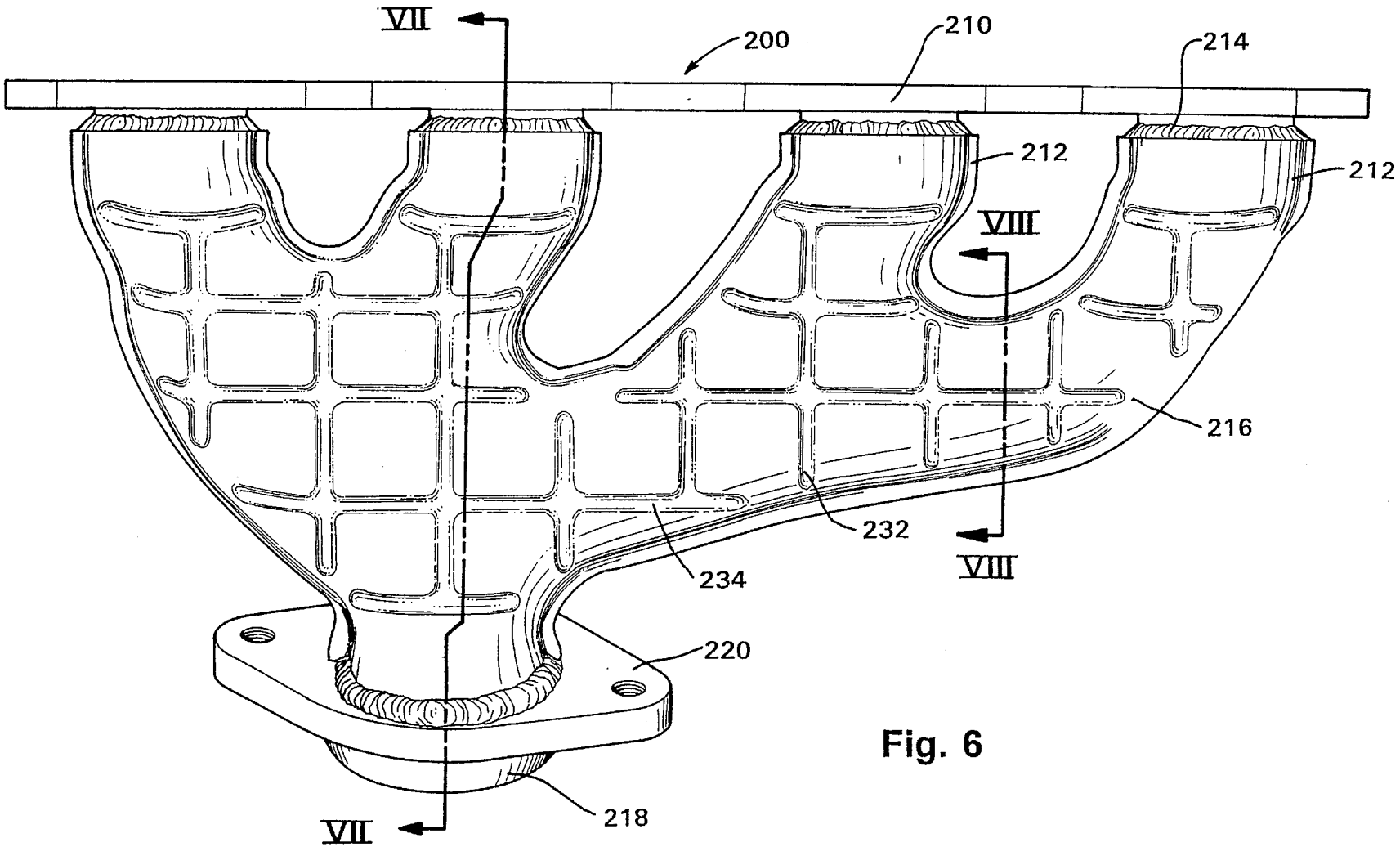
FIG. 6 is a plan view of an air gap exhaust manifold in accordance with this invention.
Figure 8:
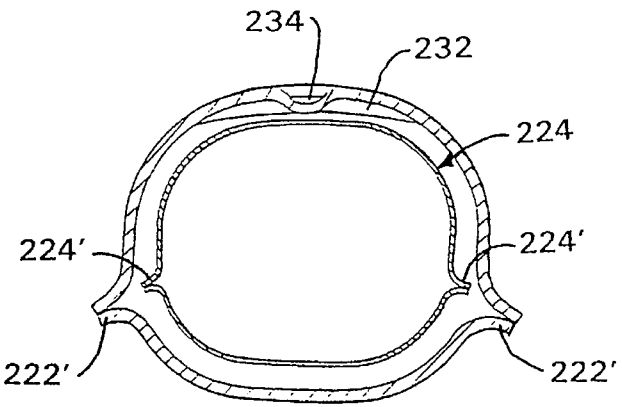
FIG. 8 is a sectional view taken on plane VIII—VIII of FIG. 6.
Figure 7:
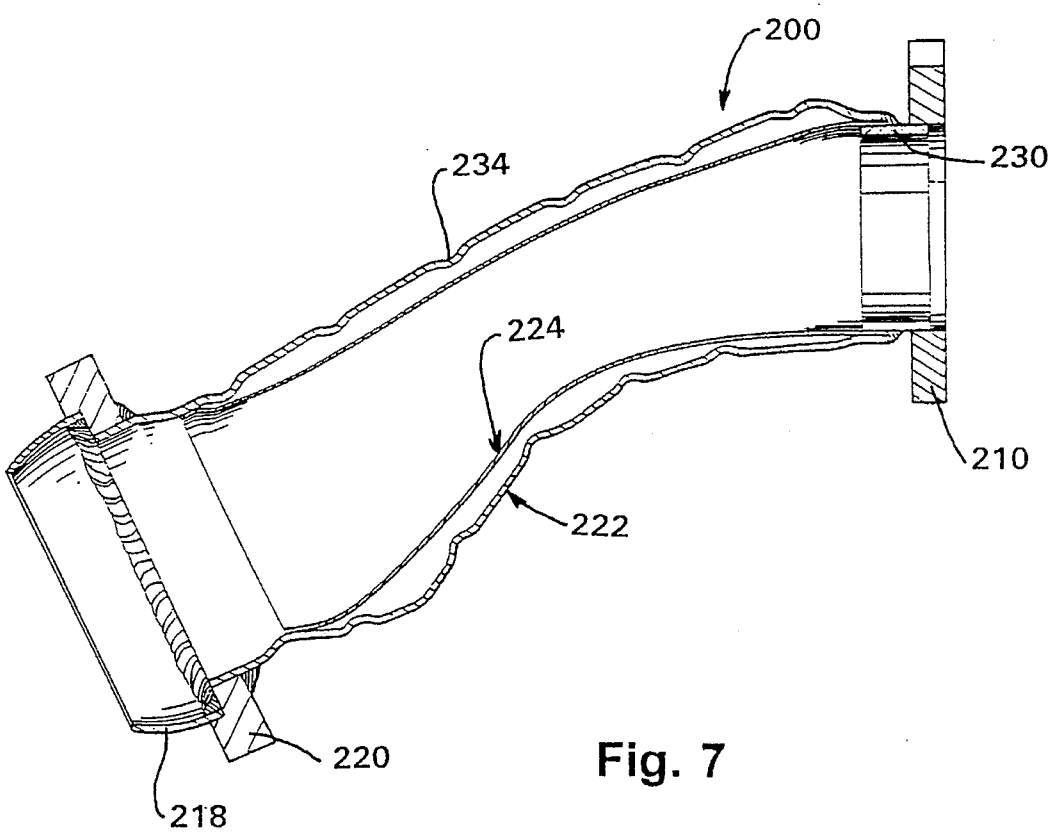
FIG. 7 is a sectional view taken on plane VII—VII of FIG. 6.

In FIGS. 6, 7 and 8 are shown an exhaust manifold conduit 200 including an elongated, planar, port flange 210 to which inlet passages 212 of the manifold are secured as by welding 214. The connection of each inlet passage 212 to port flange 210 is with an adapter sleeve 230 which is weldably attached to port flange 210 on one end and weldably attached to liner 224 and jacket 222 on its other end, the liner and jacket extending over the outer periphery of adapter sleeve 230. The manifold thus has a plurality of inlets through the runners 212 to the common log 216 which forms the common conduit for all of the exhaust passing to the outlet 218, at which is a connector flange 220 of conventional type. The manifold comprises an outer jacket 222 and an inner liner 224 (FIG. 7), both of steel, preferably stainless steel. The liner 224 has inlet passages which extend through inlet passages 212 and a common collector portion extending through collector 216. In this illustrated structure, the liner terminates short of the exit of jacket 222 at the outlet 218. Inner liner 224 is shown to terminate at its outlet end short of the outlet of jacket 222. In some manifolds, however, the liner outlet may extend to the jacket outlet. The liner is shown expanded at its outlet end to slidably engage the jacket for thermal compensation with temperature change. Liner 224 is shown to be of the clamshell type, having two longitudinally secured seams 224' secured together as by welding. Jacket 222 is also shown to be of the clamshell type, having two portions secured together along longitudinal seams 222'.

Formed into the jacket 222 is a pattern, here shown to be a waffle-type pattern, of indentation concavities or ribs extending lengthwise, 232, and crosswise, 234, of the manifold jacket, crossing each other. These concavities are shown to protrude inwardly toward liner 224, but terminate short thereof, so as not to make physical contact with liner 224. The result of this combination is a manifold with short heatup time, low thermal inertia, and yet improved acoustical characteristics. The ribs in the manifold jacket could alternatively extend outwardly, i.e., convex as viewed from the exterior, rather than concave. Optionally, the liner may have indentation ribs which protrude inwardly or outwardly, but if the latter, not engaging the jacket.

Figure 9:
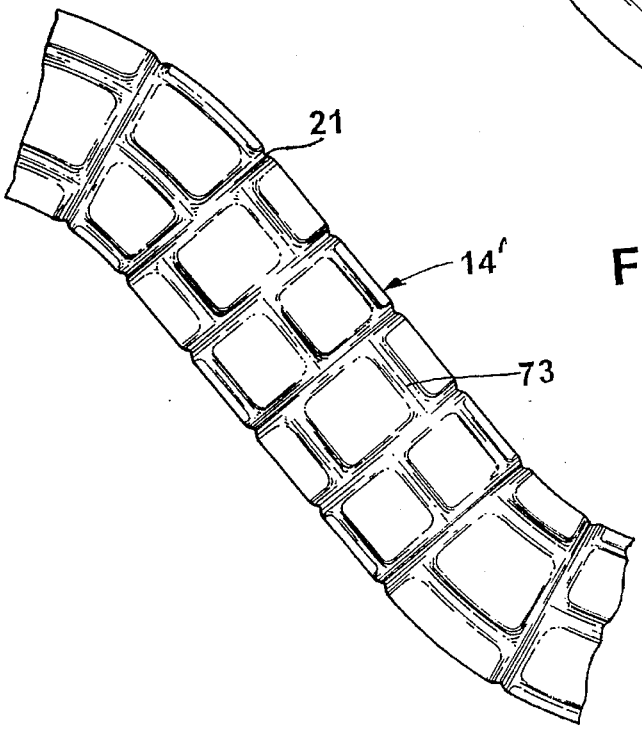
FIG. 9 is an elevational view of a liner having one type of rib pattern.

In FIG. 9 is shown a liner 14' having a series of annular rib concavities 21, and axially oriented concavities 73, in a brick-type pattern. This liner is to be combined with a jacket which may or may not have indentation ribs as described previously.

Conceivably one of the other type patterns could be applied to the exhaust manifold, the illustrated one being exemplary.

It is also possible that those in this art may consider other minor variations to the exhaust conduit components illustrated and described, within the concept presented herein. Hence, the invention is not intended to be limited to the preferred embodiments set forth as exemplary of the invention, but only by the scope of the appended claims and the reasonably equivalent structures to those defined therein, including, but not limited to, the possible alternative in which the ribs protrude outwardly rather than inwardly.

The embodiments of the invention in which an exclusive property or privilege is claimed are defined as follows.

1. An acoustically improved, air gap engine exhaust conduit comprising:

a dual wall, air gap, metal exhaust conduit having an outer metal jacket and a thin inner metal liner;

said jacket having a length, having a wall, and having at least one inlet and an outlet;

said liner having a wall, and at least one inlet and an outlet;

said jacket inlet and said liner inlet being adjacent each other;

said liner being secured to said jacket adjacent said jacket inlet and said liner inlet, said liner outlet being in engagement with said jacket, and said liner otherwise being spaced from said jacket from said liner inlet to said liner outlet to form a continuous air gap therebetween from said liner inlet to said liner outlet; and a pattern of elongated indentation ribs protruding from at least one of said jacket and said liner, said ribs extending continuously along axial paths that extend over substantially the entire length of at least one of said jacket and said liner, said indentation ribs spaced from the other of said jacket and said liner to be out of physical contact with the other of said jacket and said liner and leave an air gap between said indentation ribs and the other of said jacket and said liner to maintain said continuous air gap between said jacket and liner so as to improve the acoustical properties of said exhaust conduit.

2. The air gap engine exhaust conduit in claim 1 wherein said indentation ribs are in a waffle pattern comprising interconnected first and second indentation rib segments, said first rib segments extending along said length of said one of said jacket and liner and said second rib segments extending across said first rib segments; said one or both of said indentation rib segments forming said pattern of elongated indentation ribs.

3. The air gap engine exhaust conduit in claim 1 wherein said indentation ribs comprise interconnected annular indentation rib segments and axially oriented indentation rib segments, said axially oriented indentation rib segments being peripherally offset to form a brick-type pattern with said annular indentation rib segments, said annular indentation rib segments interconnecting said axially oriented indentation rib segments to form said pattern of said elongated indentation ribs that extend along said axial paths.

4. The air gap engine exhaust conduit in claim 2 in which said first rib segments are aligned to form said pattern of said elongated ribs that extend along said axial paths.

5. The air gap engine exhaust conduit in claim 2 in which said first rib segments are misaligned and are interconnected by said second rib segments to form said pattern of said elongated ribs that extend along said axial paths.

6. The air gap engine exhaust conduit in claim 1 wherein said indentation ribs comprise a plurality of parallel ribs which extend lengthwise of said conduit.

7. The air gap engine exhaust conduit in claim 1 wherein said conduit is a downpipe.

8. The air gap engine exhaust conduit in claim 1 wherein the conduit is an exhaust manifold.

9. The air gap engine exhaust conduit in claim 8 wherein said jacket has a plurality of inlets and said liner has a plurality of inlets, both secured to a port flange.

10. The air gap engine exhaust conduit in claim 9 wherein said manifold has a plurality of inlet passages and a collector, said inlet passages having said jacket inlets and said liner inlets and said collector having an outlet, said pattern having indentation ribs transverse to each other.

11. The air gap engine exhaust conduit in claim 1 wherein said indentation ribs are in said jacket.

12. The air gap engine exhaust conduit in claim 1 wherein said indentation ribs are in said liner.

13. An acoustically improved, air gap engine exhaust conduit comprising:

a dual wall, air gap, exhaust conduit having an outer metal jacket and a thin inner metal liner;

said jacket having a length, having a wall, and having at least one inlet and an outlet;

said liner having at least one inlet and an outlet;

said jacket inlet and said liner inlet being adjacent each other;

said liner being secured to said jacket adjacent said jacket inlet and said liner inlet, said liner outlet being in engagement with said jacket, and said liner otherwise being spaced from said jacket to form a continuous air gap therebetween from said liner inlet to said liner outlet; and a pattern of elongated indentation ribs in said jacket, said ribs extending continuously along axial paths that extend over substantially the entire length of said jacket, each indentation rib spaced from and not in physical engagement with said liner to leave an air gap between said indentation rib and said liner to maintain said continuous air gap between said jacket and liner so as to improve the acoustical properties of said exhaust conduit.

14. The air gap engine exhaust conduit in claim 13 wherein said indentation ribs are in a waffle pattern comprising interconnected first and second indentation rib segments, said first indentation rib segments extending along said length of said jacket and said second rib segments extending across said first rib segments; said one or both of said indentation rib segments forming said pattern of elongated indentation ribs.

15. The air gap engine exhaust conduit in claim 13 wherein said indentation ribs comprise spaced annular rib segments extending around said jacket and also rib segments extending axially along said jacket, said annular rib segments interconnecting said axially extended rib segments to form said pattern of said elongated ribs that extend along said axial paths.

16. The air gap engine exhaust conduit in claim 14 in which said first rib segments are aligned to form said pattern of said elongated ribs that extend along said axial paths.

17. The air gap engine exhaust conduit in claim 14 in which said first rib segments are misaligned and are interconnected by said second rib segments to form said pattern of said elongated ribs that extend along said axial paths.

* * * * *